US005638718A

United States Patent [19]

Venäläinen

[11] Patent Number: 5,638,718

[45] Date of Patent: Jun. 17, 1997

[54] EQUIPMENT AND METHOD IN VEHICLE ALIGNMENT WORK

[75] Inventor: Olavi Venäläinen, Kuopio, Finland

[73] Assignee: Autorobot Finland Oy, Kuopio, Finland

[21] Appl. No.: 500,968

[22] PCT Filed: Nov. 24, 1994

[86] PCT No.: PCT/FI94/00524

§ 371 Date: Jul. 27, 1995

§ 102(e) Date: Jul. 27, 1995

[87] PCT Pub. No.: WO95/15224

PCT Pub. Date: Jun. 8, 1995

[30] Foreign Application Priority Data

| | | | |
|---|---|---|---|
| Dec. 1, 1993 | [FI] | Finland | 935371 |
| Feb. 18, 1994 | [FI] | Finland | 940791 |

[51] Int. Cl.[6] ..... B21J 13/00

[52] U.S. Cl. ..... 72/447; 72/457; 72/705

[58] Field of Search ..... 72/705, 457, 447

[56] References Cited

U.S. PATENT DOCUMENTS

| | | | |
|---|---|---|---|
| 4,404,838 | 9/1983 | Hare | 72/457 |
| 4,660,405 | 4/1987 | Widegren et al. | 72/447 |
| 4,845,974 | 7/1989 | Bergstrom | 72/457 |
| 4,848,136 | 7/1989 | Venalainen | 72/705 |
| 4,905,496 | 3/1990 | Venalainen | 72/457 |
| 4,916,933 | 4/1990 | Celette | 72/457 |
| 4,955,224 | 9/1990 | Field | 72/457 |
| 5,186,038 | 2/1993 | Venalainen | 72/457 |
| 5,253,509 | 10/1993 | Venalainen | 72/457 |

FOREIGN PATENT DOCUMENTS

| | | | |
|---|---|---|---|
| 0297632 | 1/1989 | European Pat. Off. . | |
| 0431226 | 6/1991 | European Pat. Off. . | |
| 74635 | 8/1986 | Finland . | |
| 2246322 | 5/1975 | France | 72/705 |
| 2637205 | 4/1990 | France . | |
| 153089 | 10/1985 | Norway . | |
| 461020 | 12/1987 | Sweden . | |
| 2117347 | 10/1983 | United Kingdom . | |
| 2213411 | 7/1989 | United Kingdom | 72/705 |
| 8707190 | 12/1987 | WIPO . | |

OTHER PUBLICATIONS

Motorbranschen No. 13/73, "Tekniska hjalpmedel vid skadereparationer", pp. 639–650.

Autorobot XL 1987 Brouchure, "AutoRobot Finland KY", Kuopio.

*Primary Examiner*—Lowell A. Larson

*Assistant Examiner*—Ed Tolan

*Attorney, Agent, or Firm*—Steinberg, Raskin & Davidson, P.C.

[57] ABSTRACT

The invention concerns an equipment and a method in vehicle alignment work. Between the alignment table (11) and the base frame (10), there are vertical guides (14;14$a_1$ . . . 14$a_3$), which are connected with the alignment table (11), on one hand, and with the base frame (10), on the other hand. The function of the guides is to guide the movements of raising and lowering of the alignment table (11). It is a further function of the vertical guides to support the alignment table (11) and to keep it at the desired locked working level. The solution of equipment comprises a base frame (10) in which there are detachable drive plates ($C_1$ . . . $C_6$), which can be lifted aside for the time of the alignment work.

16 Claims, 6 Drawing Sheets

EQUIPMENT AND METHOD IN VEHICLE ALIGNMENT WORK

FIELD OF THE INVENTION

The invention concerns an equipment and a method in vehicle alignment work,

BACKGROUND OF THE INVENTION

From the prior art, devices for alignment of an automobile body are known in which the vehicle is driven onto drive plates, after which the vehicle is fixed to the fastenings on the alignment table by raising the vehicle so that its edges are supported by the fastenings at the skirts. In solutions of this sort, the lifting member is fitted to act between the drive plate and the vehicle, and the vehicle must be driven precisely to the location determined by the skirt fastenings. The solution of this sort does not include means for fixing the drive plates. Thus, when a vehicle is driven onto the drive plates, the plates tend to move.

SUMMARY OF THE INVENTION

In the present application, a novel solution of equipment is described in which the problems involved in the prior art are avoided. An inexpensive and advantageous unit of equipment has been formed, in which the drive plates for the vehicle are fixed to the base frame of the alignment equipment and in which solution of equipment the alignment table is guided by means of vertical guide means so as to fix the alignment table to the vehicle by means of its skirt fastenings. The lifting work itself takes place favorably by means of a mobile garage jack or equivalent. The alignment table is kept in its place in the alignment work position by locking the vertical guides.

In the method in accordance with the invention, the vehicle is first driven onto the drive plates, after which the alignment table is raised, for example, by means of a garage jack displaceable on wheels or equivalent. In the method in accordance with the invention, vertical guides are used for guiding the alignment table. By means of the vertical guides, the movements of raising and lowering of the alignment table are controlled, and the alignment table is locked in the desired height position. By using a garage jack or equivalent, one side of the alignment table is raised first, after which the raised side of the alignment table is locked by means of a cotter at a height of, for example, 200 mm. After this, the garage jack is moved to the other side of the alignment table, and corresponding raising is carried out, after which the guides at that side are locked by engaging the locking cotters. In the solution of the present invention, the alignment table is connected with the base frame of the equipment by means of guide pans, preferably telescopic guide parts, which base frame of the equipment rests on the floor of the workshop. The equipment includes fastening means for fastening the drive plates detachably to said base frame.

The equipment in accordance with the invention in the work of alignment of a vehicle is mainly characterized in that, between the alignment table and the base frame, there are vertical guides, which are connected with the alignment table, on one hand, and with the base frame, on the other hand, and whose function is to guide the movements of raising and lowering of the alignment table and whose function is further to support the alignment table and to keep it at the desired working level.

The method in accordance with the invention in vehicle alignment work is mainly characterized in that, in the method, the alignment table is guided by means of vertical guides fitted between the alignment table and the base frame, and that, in the method, first one side of the alignment table is raised, e.g., by means of a garage jack into contact with the vehicle, and after this the garage jack is shifted to the other side of the alignment table, and the other side of the alignment table is raised to the level corresponding to the level of the first side, and after this the guides are locked by means of lateral cotters at that level. Finally, the skirt fastenings are fixed to the vehicle, after which, as the vertical guides have been locked, the drive plates are removed.

BRIEF DESCRIPTION OF THE DRAWING

The invention will be described in the following with reference to some preferred embodiments of the invention illustrated in the figures in the accompanying drawings, the invention being, however, not supposed to be confined to said embodiments alone.

DETAILED DESCRIPTION OF THE PREFERRED EMBODIMENTS

Figure 1:
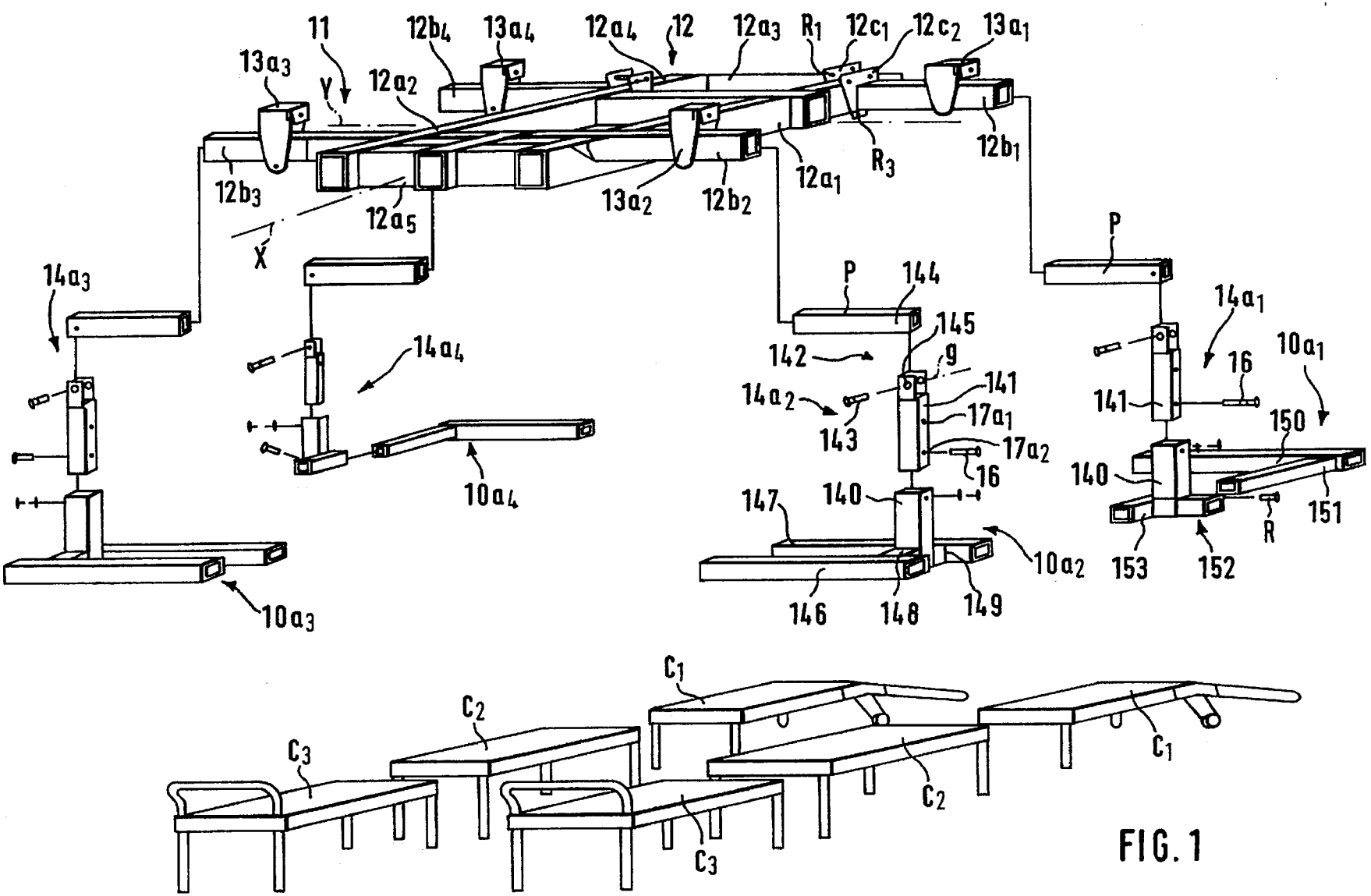
FIG. 1 is an axonometric view of an equipment in accordance with the invention with the alignment table and the base frame brought apart from one another.

FIG. 1 is an axonometric view of an equipment in accordance with the invention in vehicle alignment work. The equipment comprises an alignment table 11, which can be positioned in relation to the base frame 10. In FIG. 1, in view of clarity of illustration, the base frame 10 and the alignment table 11 are shown axonometrically and as brought apart from one another. The alignment table 11 comprises a body framework 12, which consists of beams $\mathbf{12}a_l$,$\mathbf{12}a_2$ parallel to the longitudinal axis (X-axis) of the alignment table and of cross beams $\mathbf{12}a_3$, $\mathbf{12}a_4$,$\mathbf{12}a_5$ perpendicular to said longitudinal beams. Further, the body framework 12 comprises four projecting beams, i.e. the projecting beams $\mathbf{12}b_l$,$\mathbf{12}b_2$,$\mathbf{12}b_3$,$\mathbf{12}b_4$. The positions of the projecting beams $\mathbf{12}b_1$ and $\mathbf{12}b_4$ can be adjusted so that they can be displaced in the direction of the beams $\mathbf{12}a_1$,$\mathbf{12}a_2$ parallel to the longitudinal axis (X-axis) of the alignment table, being guided by said beams. The projecting beams $\mathbf{12}b_1$,$\mathbf{12}b_4$ are; fixed to a cheek plate $\mathbf{12}c_1$, which is connected, by means of bolts $R_1$,$R_2$, $R_3$ passed across the beams, with the other cheek plate $\mathbf{12}c_2$. By tightening the bolts, the cheek: plates $\mathbf{12}c_1$,$\mathbf{12}c_2$ are pressed against the beams $\mathbf{12}a_1$,$\mathbf{12}a_2$, and the projecting beam $\mathbf{12}b_1$,$\mathbf{12}b_2$ is held as fixed to the beam construction $\mathbf{12}a_1$,$\mathbf{12}a_2$ of the alignment table 12. According to the invention, the projecting beams $\mathbf{12}b_1$ . . . $\mathbf{12}b_4$ comprise fastening members $\mathbf{13}a_1$ . . . $\mathbf{13}a_4$, i.e. so-called skirt fastenings, which can be displaced and positioned in the direction of the longitudinal axes of the projecting beams and from which the vehicle is fixed to the alignment table.

The equipment in accordance with the invention in vehicle alignment work comprises vertical guides 14$a_1$, 14$a_2$,14$a_3$ and 14$a_4$ between the alignment table 11 and the base frame 10. The function of the vertical guides is to guide and to support the alignment table during its movements of raising and lowering as well as in the working position when the vertical guides 14$a_1$,14$a_2$,14$a_3$, 14$a_4$ have been locked by means of cotters 16.

For example, the lower end of the vertical guide 14$a_1$ is attached to the base frame 10 in a freed position, and the other part of the vertical guide 14$a_1$ is attached to the alignment table 11 pivotally. In the solution in accordance with the invention, there are four vertical guides 14$a_1$,14$a_2$, 14$a_3$,14$a_4$. The vertical guides 14$a_1$,14$a_4$ are placed at the front end of the alignment table 11, and the vertical guides 14$a_2$,14$a_3$ are placed at the rear end of the alignment table 11 symmetrically at both sides of the transverse axis Y of the alignment table. According to the invention, the vertical guides 14$a_1$,14$a_2$,14$a_3$,14$a_4$ are telescopic guide pans, which comprise preferably at least two arm parts 140,141, preferably tubular parts. They are fitted to be positioned in such a way in relation to one another that one pan is placed inside the other part, being guided along the faces of said other part. The parts 140,141 are locked together by means of a cotter 16 so that at least lowering of the part 141 is prevented. The part 141 is attached to the beam P and, through it, to the alignment table 11 by means of an articulated joint 142, by means of an articulation shaft 143. The geometric axis of pivoting, i.e. the articulation axis (g), of the pivoting movement between the parts 11 and 141 is parallel to the longitudinal axis, i.e. the X-axis of the alignment table 11.

For example, as regards the guide 14$a_4$, when the cotter 16 is passed through the hole 17$a_1$ or 17$a_2$ . . . in the part 141; the parts 140,141 are locked together in such a way that the part 141 cannot be lowered into the telescopic part 140 surrounding it. When the cotter 16 has been placed into any of the holes 17$a_1$ or 17$a_2$ or 17$a_3$ . . . in the part 141, the table 11 has been locked at a certain height.

At the upper end of the part 141, there is a through hole 145. Through the hole 145, a shaft 143 is passed, which passes further into the alignment table 11, into the end of its projection beam, through the hole 144 at the end of the beam that is passed into the projection beam. The constructions of the other vertical guides are similar.

Each guide 14$a_1$,14$a_2$,14$a_3$,14$a_4$, their parts 140, are fixed stationarily to the base frame 10, to its base frame portions 10$a_1$,10$a_2$,10$a_3$,10$a_4$.

The guide 14$a_2$ is connected with the portion 10$a_2$ of the base frame 10. The base frame 10$a_2$, which is similar to the base frame portion 10$a_3$ placed at the other side, comprises beams 146,147 placed against the ground or against the floor of the, factory hall as well as cross beams 148,149 connected with said beams 146,147, which cross beams 148,149 are further connected with the part 140, whose crosssectional shape is preferably square or rectangular and which comprises a hollow space, into which the part 141 is positioned. The base frame 10 comprises a part 10$a_3$, which is similar to the part 10$a_2$. Each guide 14$a_1$, 14$a_2$,14$a_3$,14$a_4$ is supported from its end pivotally by means of an articulated joint 142 on the beam P, which has been placed into the end of the projection beams 12$b_1$,12$b_2$,12$b_3$,12$b_4$ into the interior of said projection beams telescopically.

Further, the base frame 10 comprises the base frame portions 10$a_1$, 10$a_4$, which are similar to one another. For example, the part 10$a_1$ comprises a beam 150, which is placed against the ground or against the floor of the workshop space, a beam 151 transverse to said beam 150 (and parallel to the X-axis), and a telescopically displaceable part 152, to which the part 140 is connected.

The part 152 comprises a beam 153 parallel to the longitudinal axis (X-axis) of the alignment table, which beam 153 is placed around the beam 151 and can be locked on said beam 151 in the desired position by means of a cotter or a screw R. Thus, when a skirt fastening 13$a_1$ or 13$a_4$ is displaced, the entire construction connected with the skirt fastening can be displaced in the direction of the longitudinal axis of the alignment table 11. The drive plates are denoted with $C_1$,$C_2$,$C_3$ and $C_1'$,$C_2'$,C3'.

Figure 2:
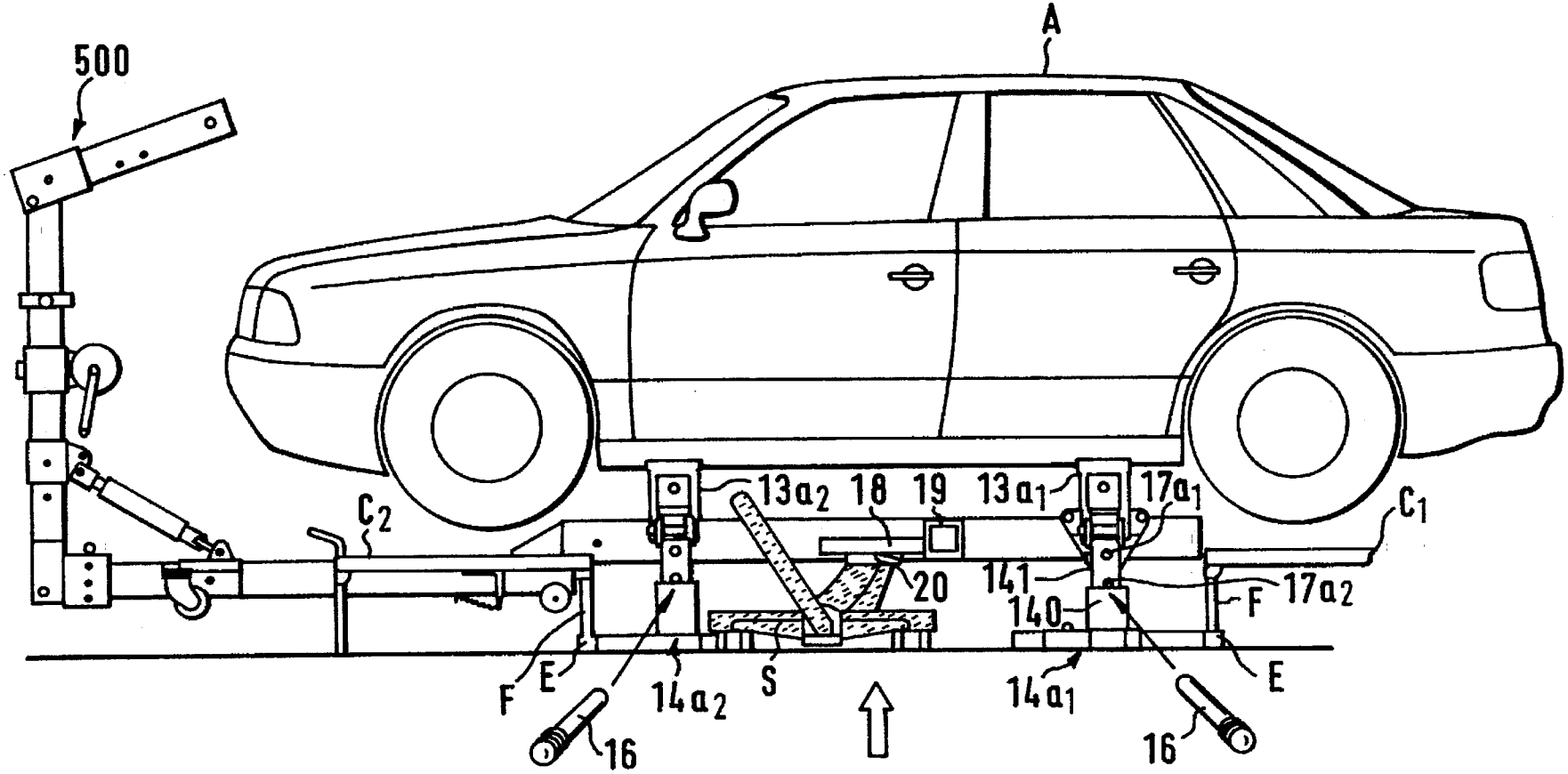
FIG. 2 shows the vehicle as attached to the alignment table and with the garage jack mounted at the lifting point.

FIG. 2 shows the vehicle A as attached to the alignment table 11. The skirt fastenings 13$a_1$ and 13$a_3$ are attached to the beam construction at the bottom of the chassis construction of the vehicle. The drive plates $C_1$ and $C_2$ are mounted on the base frame 10$a_3$ and 10$a_1$ detachably by means of their legs F. The beams of the base frame 10 that are placed against the floor of the garage space include holes E, to which the drive plates are attached by their legs.

In FIG. 2, a stage is shown in which the raising of one side of the alignment table 11 has been carried out by means of the garage jack S and, thus, the skirt fastenings 13$a_1$ and 13$a_2$ have been brought into contact with the vehicle. After this, the cotters 16 are fitted into the holes 17$a_1$ or 17$a_2$ in the parts 141, whereby lowering of the alignment table 11 is prevented and the alignment table 11 is kept on support of the cotters 16. In the figure, the alignment boom is denoted with the reference numeral 500. By means of the alignment boom 500, alignment work on the vehicle is carried out. The alignment boom 500 is attached to the alignment table 11 so that it can be positioned in relation to the table, and the alignment boom comprises a vertical arm part, which can be pivoted by means of a cylinder device in relation to the horizontal arm part, the aligning draw being carried out by means of a pulling rope or equivalent mounted on the vertical arm part and attached to the location to be aligned.

Figure 3B:
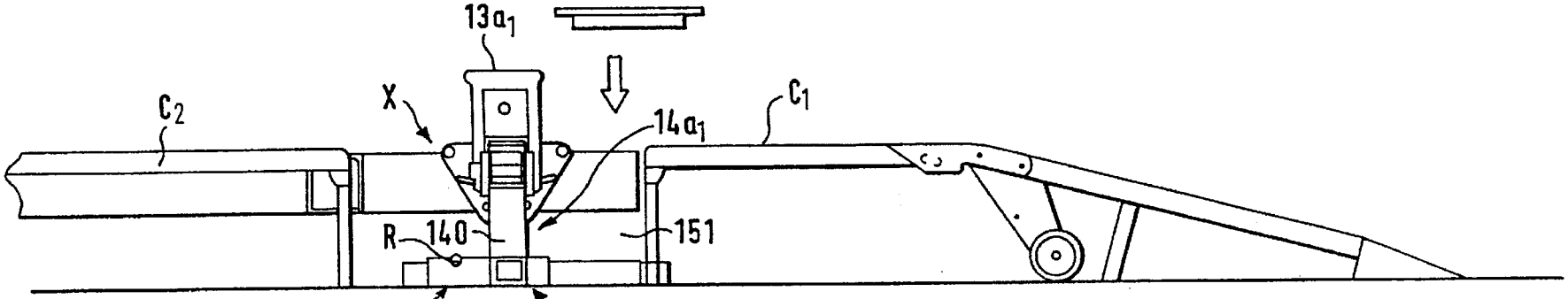
FIG. 3B shows the coupling construction between the base frame and the alignment table in the area of the displaceable skirt-fastening beams.
Figure 3A:
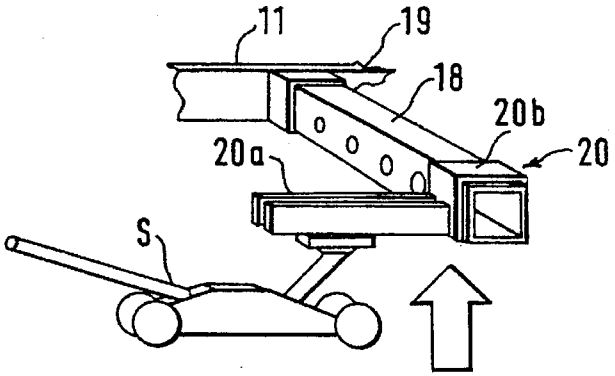
FIG. 3A is a more detailed illustration of a detachable support beam placed in the middle area of the alignment table, the garage jack performing the lifting from underneath said support beam.

FIG. 3A is a more detailed illustration of a detachable support part or support beam 18, which is placed in the middle area of the alignment table and from whose bottom side the garage jack S performs the lifting. The support beam 18 is passed into a fastening 19 placed in the middle area of the alignment table 11, which fastening 19 is preferably a beam construction, into whose beam frame the support beam 18 is fitted. The support beam 18 comprises a support part 20 fitted at the end, which support part comprises an arm part 20*a*and a beam part 20*b*, which is fitted around the support beam 18. The lifting by means of the garage jack S is carried out from underneath the part 20*a*.

FIG. 3B shows the part of the construction between the base frame portion 10$a_1$ of the base frame 10 and the skirt fastening 13$a_1$, which is displaceable in the direction of the X-axis.

Figure 3C:
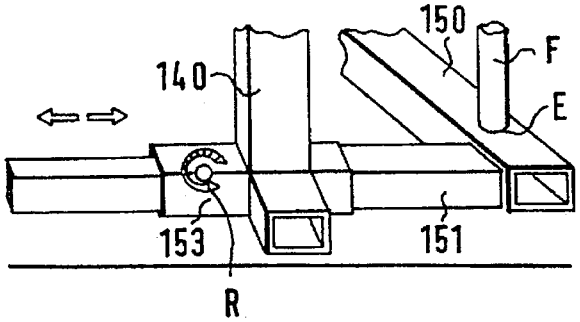
FIG. 3C shows the area X in FIG. 3B.

FIG. 3C shows the area X in FIG. 3B. The beam part 153, which is displaceable telescopically around the beam 151, is locked by means of a screw R in the desired position, which position is determined by the desired point of grasping of the skirt fastening 13$a_1$ on the vehicle. The figure shows the positioning of the leg F of the drive plate $C_1$ in the hole E in the beam 150. After the vehicle A has been raised to the desired level, the drive plates $C_1$,$C_2$,$C_3$;$C_1'$,$C_2'$,$C_3'$, can be taken apart from the base frame 10 of the alignment table 11. The drive plate $C_2$ is removed for the time of lifting, and the drive plates $C_1$ and $C_3$ are removed after lifting. The drive plates $C_1$,$C_2$,$C_3$;$C_1'$,$C_2'$,$C_3'$ are attached to their base frame portions $10a_1$,$10a_2$,$10a_3$,$10a_4$ detachably by means of their support legs F. Thus, all the drive plates at both side of the alignment table can be attached to their respective base frame portions $10a_1$,$10a_2$,$10a_3$, and $10a_4$ detachably.

Figure 3D:
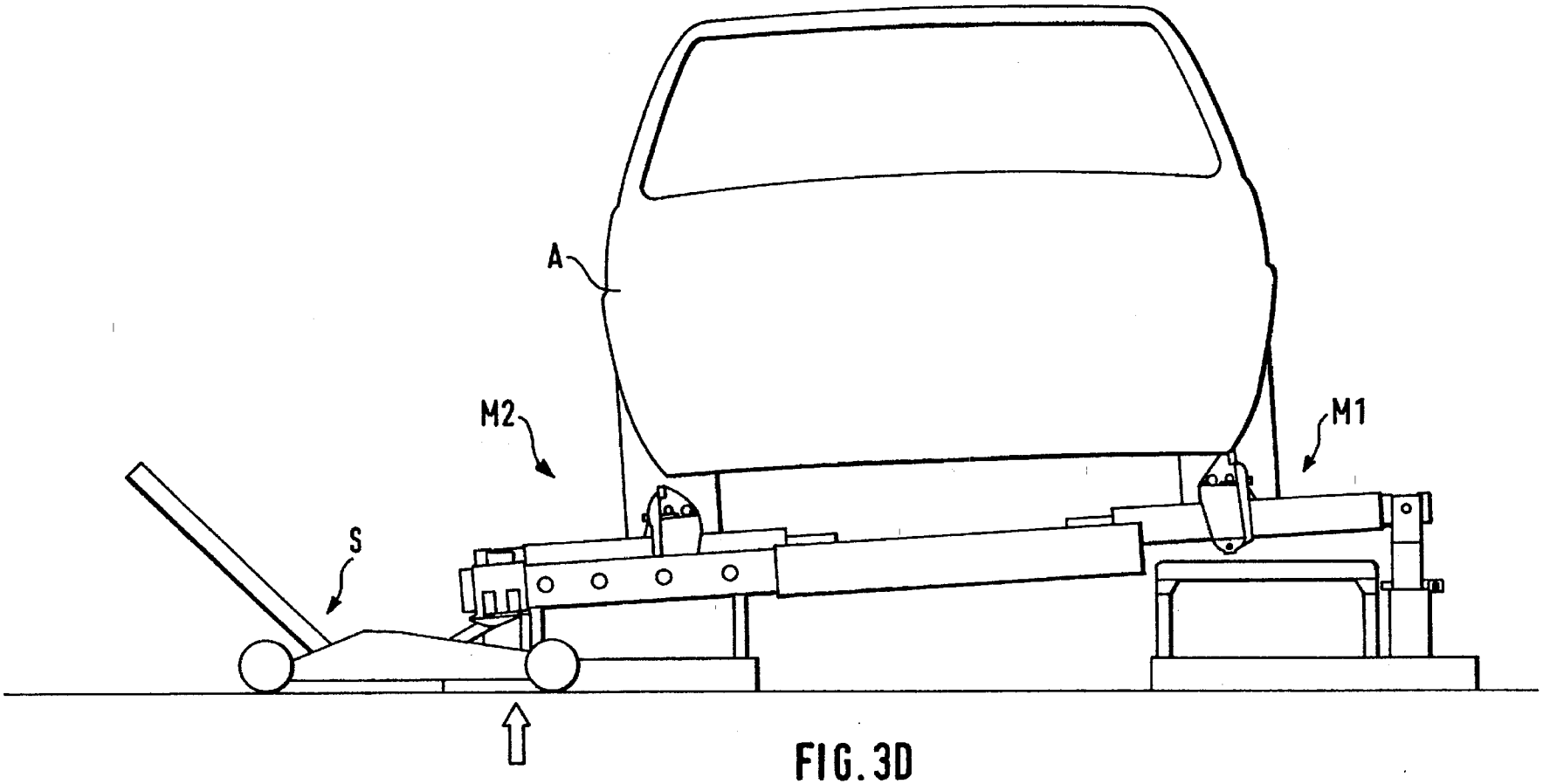
FIG. 3D illustrates the raising of the other side of the alignment table.

FIG. 3D illustrates the raising of the other side $M_2$ of the alignment table. The garage jack S has been shifted to the other side of the alignment table, from the side $M_1$ to the side $M_2$. After the side $M_2$ of the alignment table 11 has been raised to the same level as the side $M_1$, the alignment table 11 is locked by means of the cotters 16 at said level, and as the last stage the skirt fastenings $13a_1$,$13a_2$,$13a_3$,$13a_4$ are attached and tightened on the vehicle A.

Figure 4A:
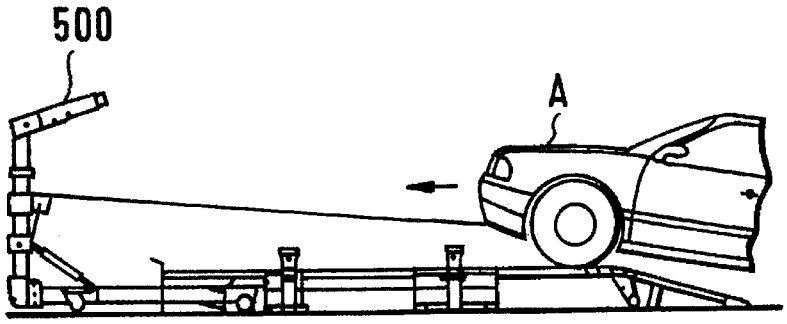
FIGS. 4A . . . 4F illustrate the raising of the alignment table in accordance with the invention step by step.

FIGS. 4A . . . 4F illustrate the fastening of the vehicle and the raising of the vehicle to the working level.

In FIG. 4A the vehicle is driven or pulled by means of a winch onto the alignment table 11 of the equipment.

Figure 4B:
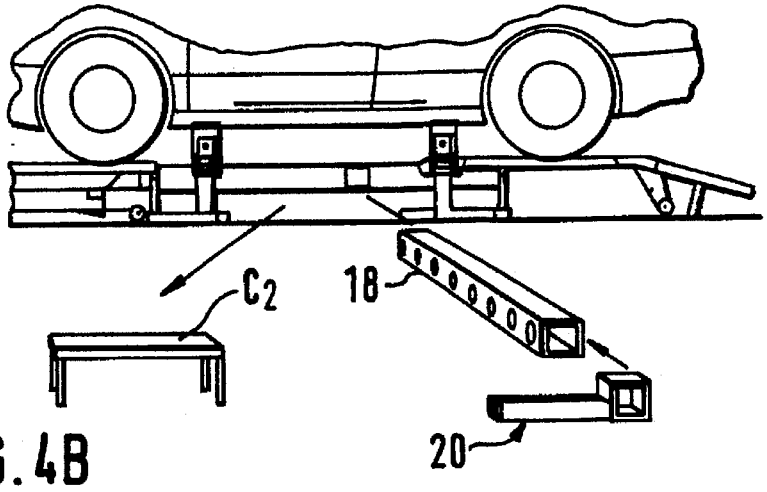

In FIG. 4B, the subsequent operations are illustrated. The vehicle is shifted far enough so that the skirt fastening $13a_3$ is at the fight location for the fastening. After this, the middle drive plate $C_2$ is removed and the support beam 18 and the support part 20 are installed in view of lifting taking place by means of a garage jack S, the garage jack S being supported on said support part 20. The raising of the alignment table 11 is carried out by means of the garage jack S, in which connection the skirt fastenings $13a_1$,$13a_2$ . . . reach contact with the bottom beams of the vehicle.

Figure 4C:
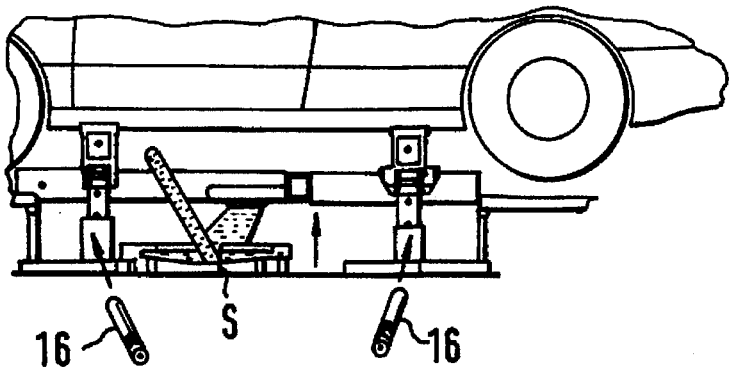

In the way shown in FIG. 4C, the cotters 16 am placed in their positions into the parts 141, whereby the working height is locked.

Figure 4D:
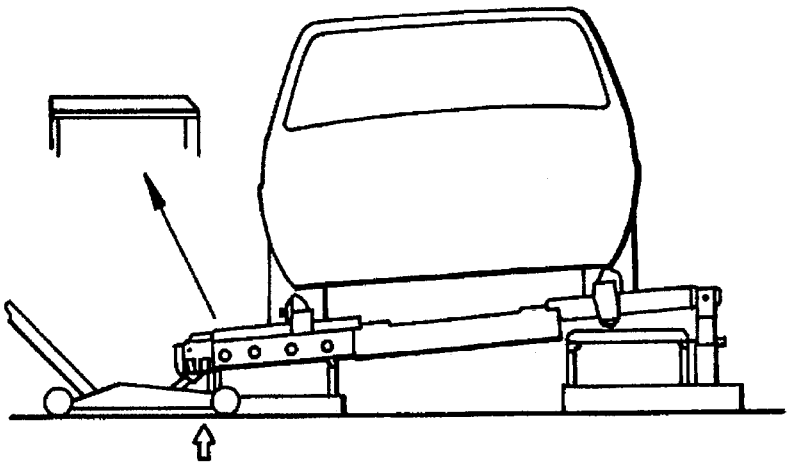

In FIG. 4D, the garage jack is shifted to the other side $M_2$ of the alignment table, and the corresponding operations are carried out.

Figure 4E:
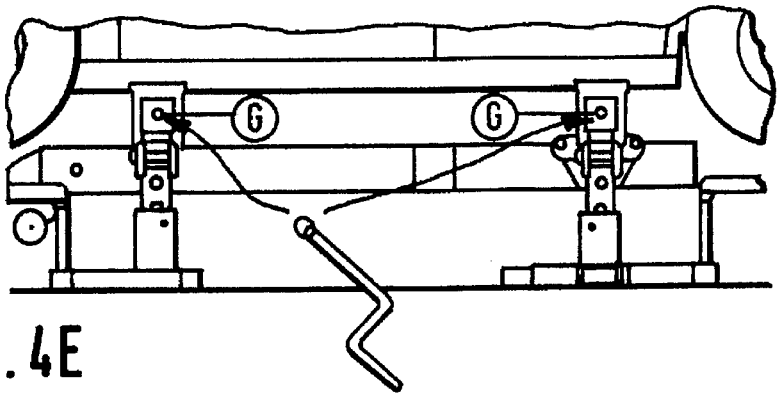

FIG. 4E shows the last stage, in which the nuts of the chassis fastenings, i.e. skirt fastenings, are tightened.

Figure 4F:
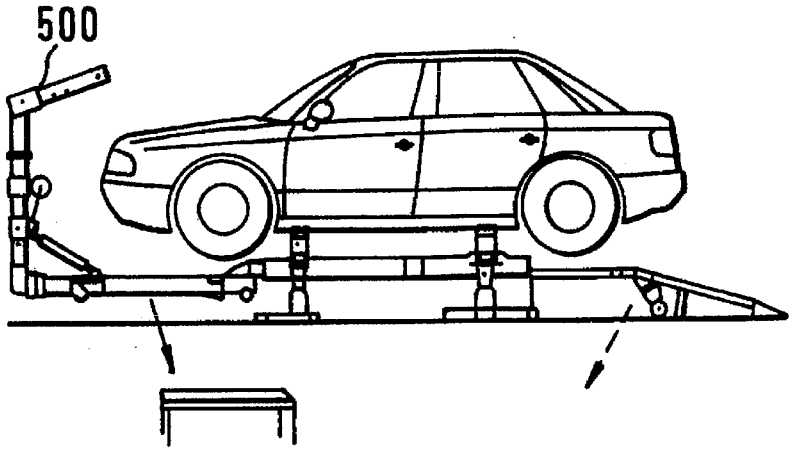

In FIG. 4F the drive plates $C_1$,$C_3$;$C_1'$,$C_3'$ are removed from both sides of the alignment table.

The detaching of the vehicle takes place in the reversed sequence.

I claim:

1. In an arrangement for aligning a vehicle comprising an alignment table, fastening members coupled thereto for grasping a vehicle in order to fix the vehicle to said alignment table, an alignment boom attachable to a location on the vehicle to be aligned, and a base frame for supporting said alignment table, said alignment table being movable relative to said base frame, the improvement comprising:

vertical guide means for controlling an adjustable vertical distance between said alignment table and said base frame, said vertical guide means comprising first and second vertical guides connected to a first side of said base frame and spaced from each other, first coupling means for pivotally coupling said first and second vertical guides to a respective first side of said alignment table such that a second side of said alignment table opposed to said first side is pivotable with respect to said first and second vertical guides, third and fourth vertical guides connected to said second side of the base frame and spaced from each other, and second coupling means for pivotally coupling said third and fourth vertical guides to a respective second side of said alignment table such that said first side of said alignment table is pivotable with respect to said third and fourth vertical guides.

2. The arrangement of claim 1, further comprising drive plates detachably connected to said base frame.

3. The arrangement of claim 2, wherein a plurality of said drive plates are positioned alongside said first and second sides of said alignment table, each of said vertical guides being arranged between an adjacent pair of said drive plates.

4. The arrangement of claim 1, wherein said alignment table has a longitudinal axis, said first coupling means comprising first articulation means arranged in connection with an upper region of each of said first and second vertical guides for enabling pivotal movement of said alignment table about a first articulation axis substantially parallel to the longitudinal axis of said alignment table, and said second coupling means comprising second articulation means arranged in connection with an upper region of each of said third and fourth vertical guides for enabling pivotal movement of said alignment table about a second articulation axis substantially parallel to the longitudinal axis of said alignment table.

5. The arrangement of claim 1, wherein said alignment table has a longitudinal axis and is substantially rectangular, said vertical guides being arranged at a respective corner of said alignment table, said first coupling means comprising first articulation means arranged in connection with an upper region of each of said first and second vertical guides for enabling pivotal movement of said alignment table about a first articulation axis substantially parallel to the longitudinal axis of said alignment table, and said second coupling means comprising second articulation means arranged in connection with an upper region of each of said third and fourth vertical guides for enabling pivotal movement of said alignment table about a second articulation axis substantially parallel to the longitudinal axis of said alignment table, further comprising connecting means for stationarily and rigidly connecting a lower region of each of said vertical guides to said base frame.

6. The arrangement of claim 1, further comprising drive plates each having a planar section and legs for supporting said planar section, and connecting means for detachably connecting at least one of said legs of each of said drive plates to said base frame.

7. The arrangement of claim 6, wherein said base frame comprises a plurality of beams, said connecting means comprising apertures arranged in said beams, each of said apertures being receivable of one of said legs of said drive plates.

8. The arrangement of claim 1, wherein each of said vertical guides comprises a first arm part, a second arm part telescopically positioned within an interior of said first arm part, and locking means for locking said second arm part relative to said first arm part, said locking means comprising vertically spaced apertures in at least one of said first and second arm parts and a cotter pin positionable within said apertures.

9. The arrangement of claim 8, wherein said alignment table has a longitudinal axis, said first coupling means comprising first articulation means arranged in connection with an upper region of said second arm part of each of said first and second vertical guides for enabling pivotal movement of said alignment table about a first articulation axis substantially parallel to the longitudinal axis of said alignment table, said second coupling means comprising second articulation means arranged in connection with an upper region of said second arm part of each of said third and fourth vertical guides for enabling pivotal movement of said alignment table about a second articulation axis substantially parallel to the longitudinal axis of said alignment table.

10. The arrangement of claim 9, wherein said alignment table is substantially rectangular and said vertical guides are arranged at a respective corner of said alignment table, further comprising connecting means for stationarily and rigidly connecting a lower region of each of said vertical guides to said base frame.

11. The arrangement of claim 9, wherein said first coupling means comprise a projection beam connected to said alignment table at a location of each of said first and second vertical guides and said second coupling means comprise a projection connected to said alignment table at a location of each of said third and fourth vertical guides, said first articulation means comprising an aperture in said upper region of said second arm part of each of said first and second vertical guides, an aperture in each of said projection beams at the locations of said first and second vertical guides, and a substantially cylindrical shaft extending through said aperture in said projection beam and said aperture in said second arm part of an aligned one of said first and second vertical guides such that said projection beam is rotatable about said shaft relative to said vertical guide, said second articulation means comprising an aperture in said upper region of said second arm part of each of said third and fourth vertical guides, an aperture in each of said projection beams at the locations of said third and fourth vertical guides, and a substantially cylindrical shaft extending through said aperture in said projection beam and said aperture in said second arm part of an aligned one of said third and fourth vertical guides such that said projection beam is rotatable about said shaft relative to said vertical guide.

12. The arrangement of claim 1, further comprising lifting and support means for enabling a lifting force to be applied to said alignment table, said lifting and support means comprising a support beam connected to each side of said alignment table and a support part mounted on each of said support beams, said support part having an arm part extending outward from said support beam and having a surface adapted to engage with a lifting device such that a lifting force supplied by the lifting device is transferable through said arm part, said support part and said support beam to said alignment table.

13. The arrangement of claim 1, wherein said alignment table comprises elongate projecting beams and said fastening members are arranged on said projecting beams, further comprising a beam arranged to engage with an end of each of said projecting beams, said vertical guides being connected to a respective one of said beams arranged to engage with an end of each of said projecting beams.

14. The arrangement of claim 1, further comprising drive plates connected to said base frame for supporting the vehicle, said alignment table being movable from a vertical height below a vertical height of said drive plates at which said drive plates support the vehicle to a vertical height above the vertical height of said drive plates such that said drive plates cease supporting the vehicle and are removable.

15. In an arrangement for aligning a vehicle comprising an alignment table, fastening members coupled thereto for grasping a vehicle in order to fix the vehicle to said alignment table, an alignment boom attachable to a location on the vehicle to be aligned, and a base frame for supporting said alignment table, said alignment table being movable relative to said base frame, the improvement comprising:

vertical guide means for controlling an adjustable vertical distance between said alignment table and said base frame, said vertical guide means comprising first and second vertical guides connected to a first side of said base frame and spaced from each other, first coupling means for coupling said first and second vertical guides to a respective first side of said alignment table, third and fourth vertical guides connected to said second side of the base frame and spaced from each other, and second coupling means for coupling said third and fourth vertical guides to a respective second side of said alignment table, and lifting and support means for enabling a lifting force to be applied to said alignment table, said lifting and support means comprising a support beam connected to each side of said alignment table and a support part mounted on each of said support beams, said support part having an arm part extending outward from said support beam and having a surface adapted to engage with a lifting device such that a lifting force supplied by the lifting device is transferable through said arm part, said support part and said support beam to said alignment table.

16. A method for preparing a vehicle body for alignment of a part thereof, comprising the steps of:

driving a vehicle onto drive plates arranged above an alignment table and detachably connected to a base frame, raising first skirt fastenings at a first side of the alignment table into contact with a respective first side of the vehicle by raising vertical guides at the first side of the alignment table to which the first skirt fastenings are coupled, locking the vertical guides at the first side of the alignment table to thereby lock the first side of the alignment table at a certain level, raising second skirt fastenings at a second side of the alignment table opposed to the first side into contact with a respective second side of the vehicle by raising vertical guides at the second side of the alignment table to which the second skirt fastenings are coupled, locking the vertical guides at the second side of the alignment table to thereby lock the second side of the alignment table at a certain level, and removing the drive plates out of connection with the base frame.

* * * * *